United States Patent [19]

Miller

[11] 4,376,302

[45] Mar. 8, 1983

[54] PIEZOELECTRIC POLYMER HYDROPHONE

[75] Inventor: Harry B. Miller, Niantic, Conn.

[73] Assignee: The United States of America as represented by the Secretary of the Navy, Washington, D.C.

[21] Appl. No.: 895,828

[22] Filed: Apr. 13, 1978

[51] Int. Cl.[3] ..... H04R 17/00

[52] U.S. Cl. ..... 367/157; 310/358; 310/366; 310/800; 367/141

[58] Field of Search ..... 310/800, 366, 358; 340/10; 367/157, 141

[56] References Cited

U.S. PATENT DOCUMENTS

| | | | |
|---|---|---|---|
| 2,875,355 | 2/1959 | Petermann | 310/366 |
| 3,750,127 | 7/1973 | Ayers | 310/800 |
| 3,781,955 | 1/1974 | Lavrinenko et al. | 310/358 |
| 3,798,474 | 3/1974 | Cassand et al. | 310/800 |
| 4,056,742 | 11/1977 | Tibbetts | 310/800 |
| 4,129,799 | 12/1978 | Green | 310/366 |

*Primary Examiner*—Harold J. Tudor

*Attorney, Agent, or Firm*—Robert F. Beers; Arthur A. McGili; Prithvi C. Lall

[57] ABSTRACT

A piezoelectric polymer hydrophone including a single flexible sheet of a piezoelectric polymer having a plurality of electrode strips on the top and bottom of the sheet. The electrode strips at the top are staggered by one half the width of a strip relative to the corresponding strips at the bottom of the sheet. The polymer sheet can be rolled into a helix without losing its acoustic sensitivity.

2 Claims, 4 Drawing Figures

PIEZOELECTRIC POLYMER HYDROPHONE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention generally relates to a device for sensing acoustic signals and converting them to corresponding electrical signals and vice versa. The invention more particularly relates to a hydrophone which uses a sheet of a piezoelectric polymer which is polarized and is provided with the leads to pick off the voltage output generated as a result of an impinging acoustic pressure wave.

Piezoelectric polymer technology for using microphones and hydrophones is in its infancy. To use such a material for a hydrophone in acoustic line arrays, the hydrostatic mode using the piezoelectric constant $d_h$ rather than the more sensitive $d_{31}$ is preferred. It has been found that the open-circuit voltage sensitivity of a polymer hydrophone, using the hydrostatic mode, is inherently very low. Even worse, we must deal with the resultant sensitivity, reduced by the input capacitance of the amplifier. If this input capacitance is much smaller than the effective capacitance of the polymer hydrophone, the resultant sensitivity is approximately proportional to the ratio of the piezoelectric constant, $d_h$, of the polymer to the square root of its resultant capacitance $C_s$ which is obtained by summing the capacitances of its "n" component strips connected in series, i.e., in this case the sensitivity is approximately proportional to the product of n and $d_h$. Since the original capacitance $C_o$ of the polymer sheet is normally much larger than the input capacitance of the amplifier, it is possible to trade off a lower value of the effective capacitance $C_s$ or $C_o/n^2$ for a higher effective sensitivity of the polymer hydrophone. An optimum occurs when the input capacitance of the amplifier is approximately equal to $C_s$, the effective capacitance of the polymer sheet. This is so because the resultant sensitivity S is exactly given by $$S = \left(\frac{1}{n} \cdot d_h \cdot A\right) / (C_o/n^2 + C_{in}),$$

where n is the number of strips into which the polymer sheet has been divided; $d_h$ is the piezoelectric constant; A is the area of the polymer; $C_o$ is the capacitance of the original polymer sheet before it has been divided (i.e., $n=1$); and $C_{in}$ is the input capacitance of the amplifier. It should be remembered that $C_o/n^2=C_s$, the effective capacitance. One way to increase sensitivity is to connect a number of polymer strips electrically in series and then cement the strips into a composite thick strip. The thick strip so made increases the sensitivity depending upon the number of strips used (at the expense of the capacitance value, which is reduced). However, it is difficult to make a usable composite thick strip because of the problem of entrapped air bubbles. It is thus desirable to have a hydrophone which uses a single flexible piezoelectric polymer sheet with many strips electrically connected in series, without the necessity of compositing a thick strip.

SUMMARY OF THE INVENTION

The piezoelectric polymer hydrophone of the present invention includes a single flexible sheet of a piezoelectric polymer having a plurality of electrode strips of uniform width (i.e., "standard strips") on the top and the bottom surfaces of the sheet which are so arranged that they form a number of unit-cell hydrophones connected electrically in series. However, one strip at the top extreme end and one strips at the opposite extreme end but at the bottom, are half-width strips. The electrode strips are preferably staggered by one half the width of the standard strip (i.e., full-width strip) relative to the corresponding strips at the bottom of the sheet. Alternatively, all strips could be of the same width (i.e., half the width of the standard strip) and two adjoining half-width strips at a time could be shorted together to form a full-width strip and produce in effect staggered full-width strips as described above. The resulting unit cell hydrophones are thus automatically connected electrically in series. This requires only two output leads instead of a plurality of leads from the hydrophone. The polymer sheet can be rolled into a helix or some other configuration without losing its acoustic sensitivity. Two electrical leads are provided for carrying the voltage signal generated by the acoustic pressure wave impinging on such a hydrophone. The metalized electrode strips are so arranged that they are connected in series and produce a relatively large voltage signal when the hydrophone is subjected to the acoustic field of an acoustic source.

An object of the subject invention is to provide an improved hydrophone using a piezoelectric polymer.

Another object of subject invention is to have a hydrophone which is used in hydrostatic mode.

Still another object of subject invention is to have a hydrophone which is shock resistant.

Still another object of subject invention is to have a hydrophone which is relatively inexpensive. Other objects, advantages and novel features of the invention will become apparent from the following detailed description of the invention when considered in conjunction with the accompanying drawings wherein:

DESCRIPTION OF THE PREFERRED EMBODIMENTS

Figure 1:
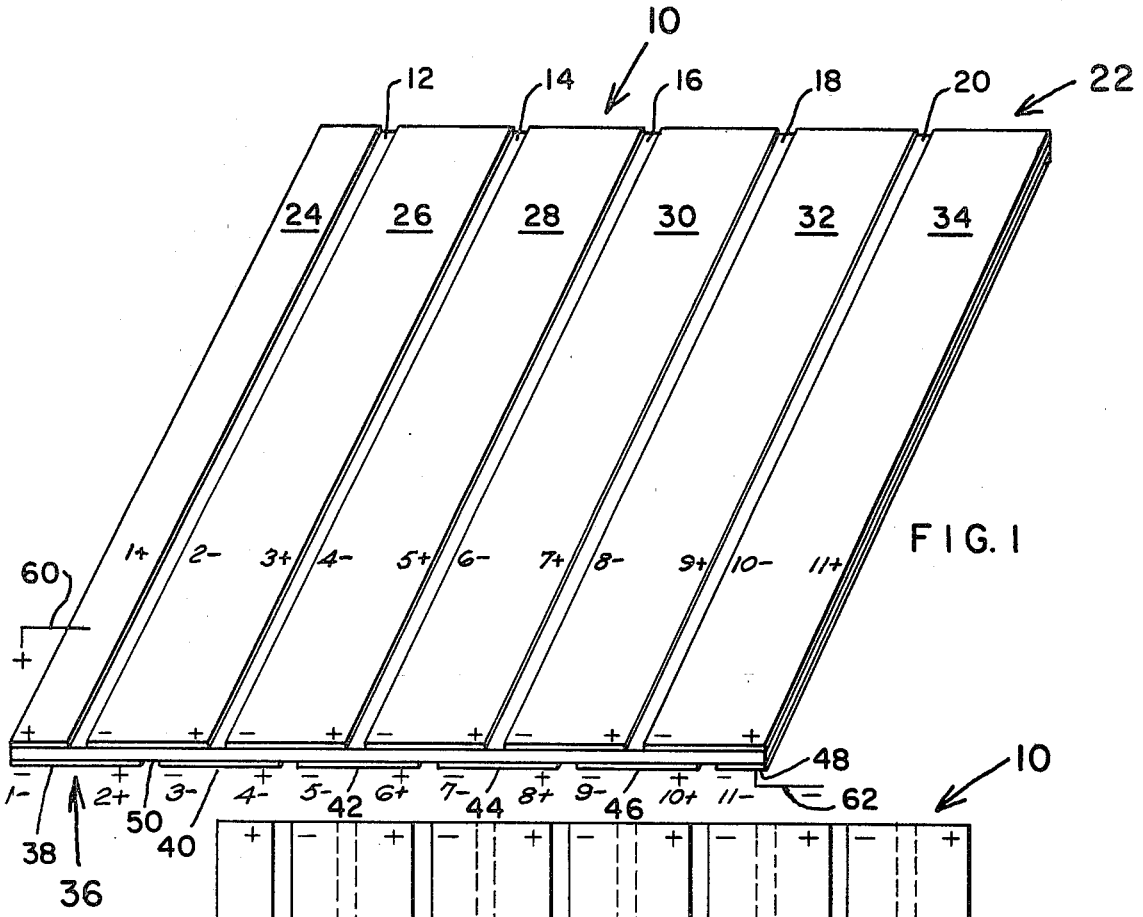
FIG. 1 is a schematic representation of a piezoelectric polymer hydrophone.
Figure 2:
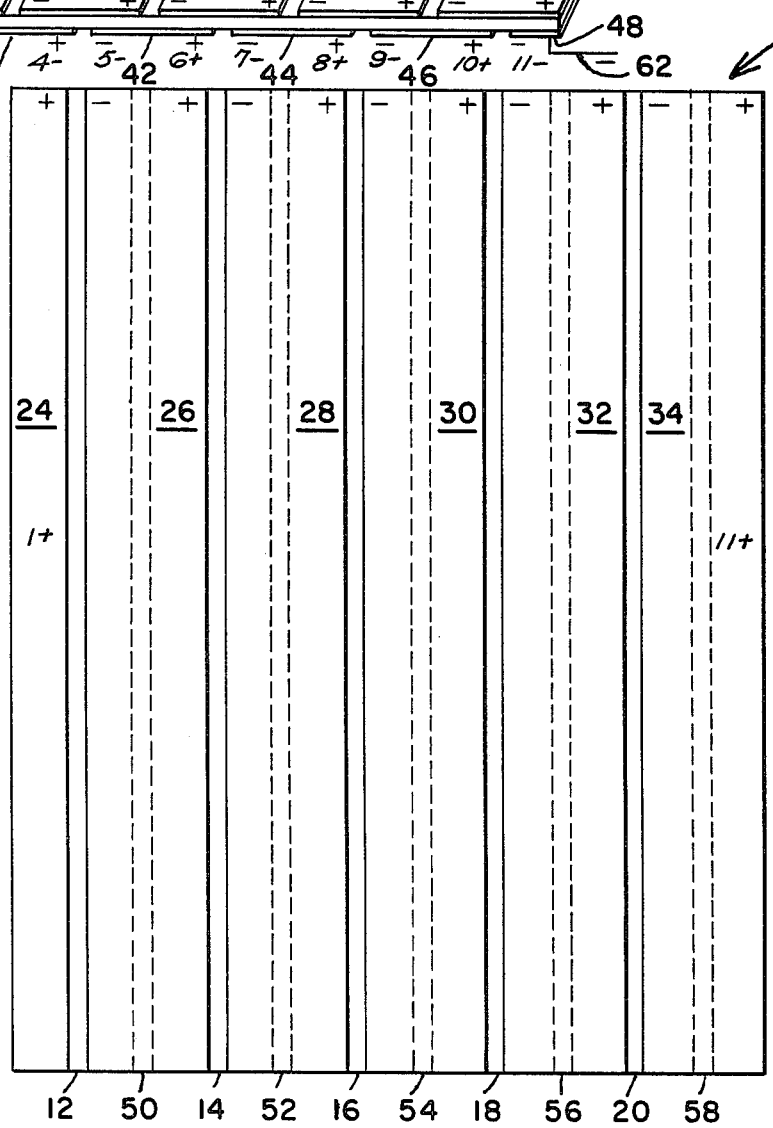
FIG. 2 is a top view of the piezoelectric polymer hydrophone of FIG. 1.

Referring to the drawings, FIG. 1 schematically shows the piezoelectric polymer sheet 10 which is used to make a piezoelectric polymer hydrophone of high sensitivity according to the teachings of subject invention. Piezoelectric polymer sheet 10 is preferably made of polyvinylidene fluoride ($PVF_2$) which is a high molecular weight polymer. However, other polymers having similar piezoelectric properties can be used without deviating from the teachings of subject invention. Polymer sheet is generally a rectangular sheet which is deposited with an evaporated metallic film such as an aluminum film except at the masked areas such as 12, 14, 16, 18 and 20 at the top surface 22 of sheet 10. This forms metalized strips 24, 26, 28, 30, 32 and 34 at the top 22 of polymer sheet 10. An insulating or masking tape is used to mask the areas mentioned above. The bottom surface 36 of polymer sheet 10 is likewise deposited with an evaporated metallic film forming strips 38, 40, 42, 44, 46 and 48 except at the masked areas 50, 52, 54, 56 and 58 as shown in FIG. 2. The widths of metalized strips 24 and 48 of polymer sheet 10 are half the width of the metalized strips such as 26, 28, 30, 32, 34, 38, 40, 42, 44 and 46. Furthermore, the metalized strips on top surface 22 of polymer sheet 10 are staggered from the corresponding metalized strips at bottom surface 36 of polymer sheet 10 by half the width of each of strips 26, 28, 30, 32, 34, 38, 40, 42, 44 and 46. Removal of the masking tape from spaces 12, 14, 16, 18, 20 and respective spaces at bottom surface 36 of polymer sheet 10 leaves the insulating gap in between vraious strips as shown in FIGS. 1 and 2. A pair of conducting metal bars, preferably made of copper, each having width equal to that of strip 24 or 48 is used to polarize the strips of polymer sheet 10 by placing one of these metal bars on metalized strip 24 and the other metal bar on the corresponding portion of strip 38 at the bottom 36 of polymer sheet 10. An electrical field, preferably of the order of $5\times10^5$ volts per centimeter, is applied to the metal bars so that the positive electrode plate is at strip 24 and the negative electrode plate is at the corresponding half of strip 38. The electrode bar for the top layer is then moved to that half of strip 26 which is closer to insulating space 14 and the corresponding electrode bar for the bottom portion of the polymer sheet 10 to its corresponding bottom area, i.e., the half-width of strip 40 which is closer to insulating space 50. The same electric field is applied between the two electrode plates. This process is repeated until that half of each of strips 28, 30, 32 and 34 which is closer to the respective insulating spaces 16, 18 and so forth is polarized positive and the corresponding bottom area polarized as negative. Thereafter, the polarity on the electrode bars is changed making the top electrode bar to be negative and the corresponding bottom electrode bar to be positive. The polarization process is repeated so as to make the remaining half of strips 26, 28, 30, 32 and 34 as negative and their corresponding portions of the bottom strips as positive. It should be pointed out that an alternative way of polarizing the metalized strips of the polymer sheet 10 is to polarize all the positive parts of the strips at the top and the corresponding negative strips of the bottom and then turn the polymer sheet back side forward so as to reverse the position of the top and bottom surfaces of the polymer sheet 10; and then go through the same process. It is preferred that the thickness of the polymer sheet is of the order of $3\times10^{-2}$ millimeters or so. It has been found that if the effective thickness of the polymer sheet is greater than about $3\times10^{-2}$ m.m., (as would occur when the polymer is folded back and forth into a multi-layered stack and polarized as a single stack) the resulting polarization becomes deteriorated. In other words, the uniformity of the polarization is poorer, and the maximum attainable sensitivity level is lower than when only a single layer at a time is polarized. Moreover, the high electric field required increases the frequency of occurrence of voltage breakdown during polarization. FIG. 2 shows the top face portion of the polymer sheet 10 wherein solid line spaces 12, 14, 16, 18 and 20 are the insulating spaces between the various strips at the top face and the dotted line spaces such as 50, 52, 54, 56 and 58 are the insulating spaces between the various strips at the bottom face 36 of polymer sheet 10. After the strips at the top face 22 and bottom face 36 of polymer sheet are polarized as shown in FIG. 1, a positive lead 60 is taken out from the top strip 24 and a negative lead 62 is taken out of last bottom strip 48. An acoustic pressure wave impinging on the polymer sheet placed in a liquid medium then generates an electrical voltage signal between terminals 60 and 62 which is proportional to the impinging acoustic pressure wave.

Figure 3:
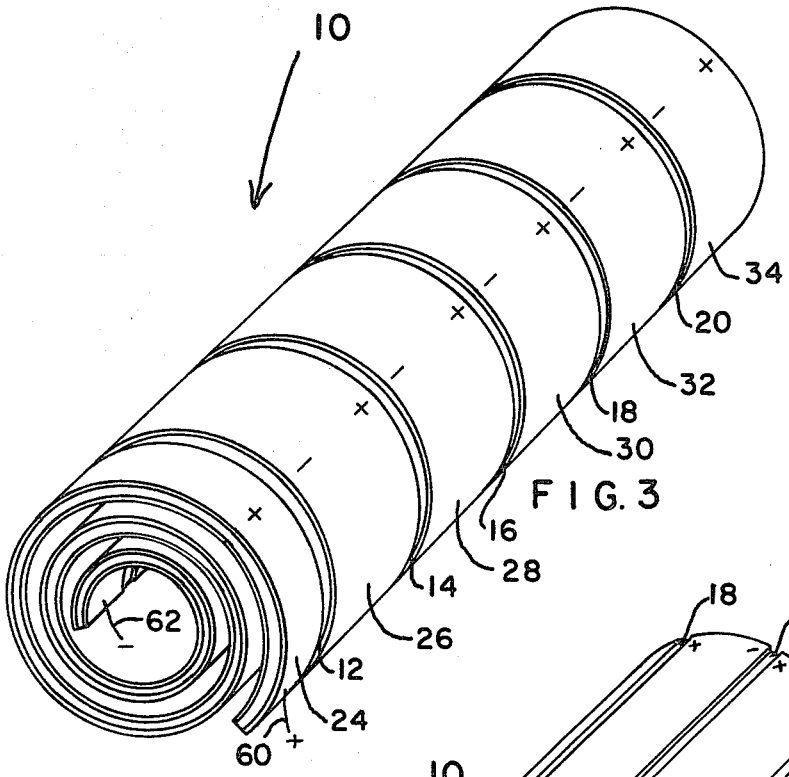
FIG. 3 shows a hydrophone wherein the polymer sheet has been rolled lengthwise into a helix.
Figure 4:
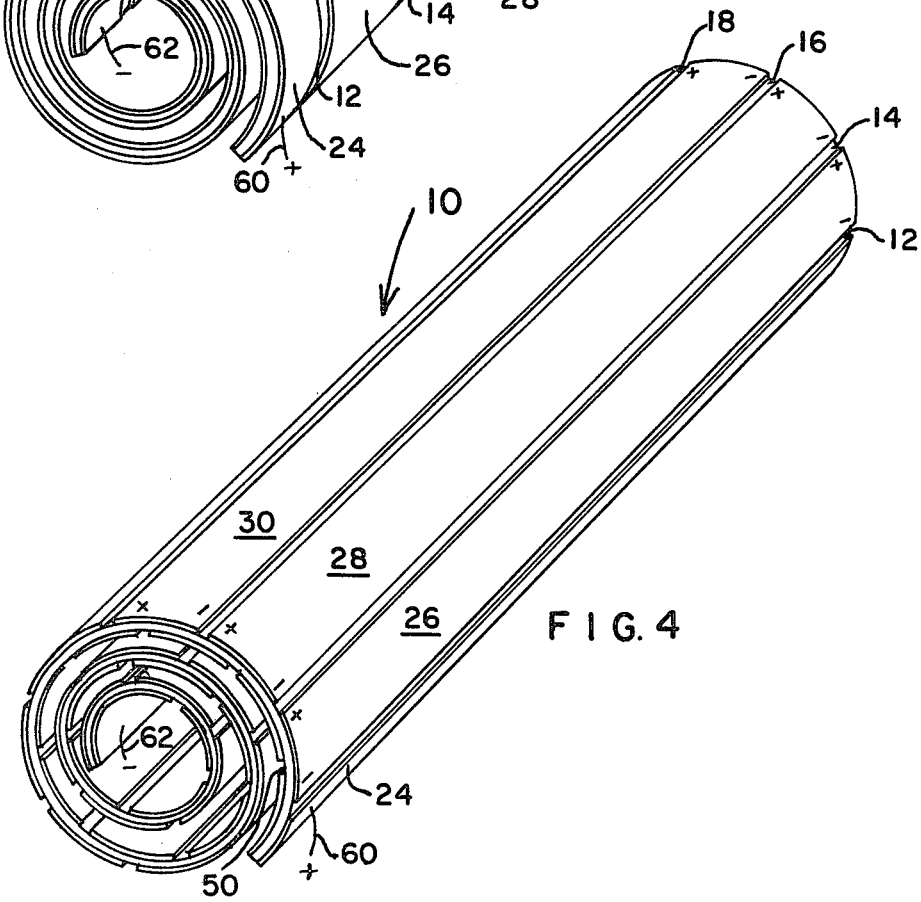
FIG. 4 shows another hydrophone wherein the piezoelectric sheet has been rolled widthwise to form another embodiment of subject invention.

FIG. 3 is the first embodiment of the transducer which uses polarized polymer sheet 10 as shown in FIG. 1 and wherein the top surface is covered with a thin insulating material, preferably Mylar sheet having a thickness of the order of a few Angstroms ($10^{-10}$ meter), and then rolled into a helical configuration. The voltage signal generated is taken across terminals 60 and 62 as shown in FIGS. 1 and 3. The second embodiment is configured by covering the top of polymer sheet 10 with a thin insulating material, preferably a Mylar sheet of thickness a few Angstroms and rolling it into a helix by rolling it edgewise as shown in FIG. 4. The voltage signal is generated between terminals 60 and 62 due to an impinging acoustic wave as shown in FIG. 4. The thin sheet of Mylar can be substituted with a thin vinyl sheet or any other material having low dielectric constant so as to minimize undesirable capacitor effects in the transducer. The transducer as shown in either FIG. 3 or FIG. 4 is then placed in a body of water where the acoustic pressure wave from and acoustic source is present. The impinging acoustic pressure wave generates a voltage signal between terminals 60 and 62 which is processed to extract information regarding the impinging acoustic pressure wave.

Briefly stated, a piezoelectric polymer hydrophone according to the teachings of subject invention includes a single flexible sheet of a piezoelectric polymer such as polyvinylidene fluoride ($PVF_2$) having a plurality of metalized electrode strips on the top and bottom faces of the sheet. The electrode strips at the top face of the polymer sheet are staggered by one half the width of a regular strip relative to the corresponding electrode strip at the bottom face of the polymer sheet. The electrode strips are so arranged that they are connected in series and produce a relatively large voltage signal when the hydrophone is subjected to an acoustic field of an acoustic source. It should be noted that if we had not used alternately polarized adjacent strips we would have had to use a plurality of leads looping from each top half-width strip to the adjacent bottom half-strip, leading to a cumbersome construction. The polymer sheet can be rolled into a helix or some other configuration without losing any acoustic sensitivity. Obviously, many modifications and variations of the present invention may become apparent in the light of the above teachings. As an example, the use of a sheet of piezoelectric polymer such as polyvinylidene fluoride ($PVF_2$) can be substituted with some other piezoelectric polymer having similar characteristics. Furthermore, the thin sheet used to cover the top of the piezoelectric polymer sheet before rolling into a helix or other configuration can be some other material than Mylar or vinyl, having a low dielectric constant. Furthermore, the process of polarizing the various strips at the top and bottom surfaces of the polymer sheet can be accomplished in a variety of ways without deviating from the teachings of subject invention. It is therefore understood that within the scope of the appended claims the invention may be practiced otherwise than as specifically described.

I claim:

1. A device for converting acoustic signals into electric voltage signals comprising:

at least one relatively thin sheet of a piezoelectric polymer having a first plurality of metalized strips on the top surface thereof, having adjacent members separated by a first group of insulating spaces; and a second plurality of metalized strips at the bottom surface thereof, having adjacent members separated by a second group of insulating spaces; the members of said first plurality of metalized strips being staggered from the corresponding members of said second plurality of metalized strips; adjacent strips of said polymer sheet associated with said first plurality of metalized strips and said second plurality of metalized strips having been polarized and being automatically and inherently electrically connected in series for generating electric voltage signals in response to the acoustic signals.

2. The device of claim 1 wherein said adjacent strips of polymer sheet are polarized in alternate directions.

* * * * *